US007527525B2

(12) United States Patent
Long et al.

(10) Patent No.: US 7,527,525 B2
(45) Date of Patent: May 5, 2009

(54) JACK CONNECTOR

(75) Inventors: Ji-En Long, ShenZhen (CN); Wei-Nan Kuo, Tu-Cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/897,120

(22) Filed: Aug. 29, 2007

(65) Prior Publication Data

US 2008/0057791 A1 Mar. 6, 2008

(30) Foreign Application Priority Data

Aug. 29, 2006 (CN) ..... 2006 2 0075801

(51) Int. Cl.
*H01R 13/648* (2006.01)

(52) U.S. Cl. ..... 439/607

(58) Field of Classification Search ..... 439/626, 439/607, 609, 63, 668, 669, 910
See application file for complete search history.

(56) References Cited

U.S. PATENT DOCUMENTS 5,338,215 A * 8/1994 Lee et al. ..... 439/188
D379,969 S * 6/1997 Tan ..... D13/147
5,893,767 A * 4/1999 Broschard, III ..... 439/188
6,190,205 B1 * 2/2001 Wu ..... 439/607
6,244,905 B1 * 6/2001 Wang ..... 439/668
6,478,594 B1 * 11/2002 Curtin et al. ..... 439/188
6,482,044 B1 * 11/2002 Ma et al. ..... 439/668
6,568,963 B2 * 5/2003 Zhang et al. ..... 439/188
6,997,742 B1 * 2/2006 Tung ..... 439/541.5
7,101,230 B2 * 9/2006 Ma ..... 439/668
2004/0259418 A1 * 12/2004 Chu et al. ..... 439/607

* cited by examiner

*Primary Examiner*—Alexander Gilman
(74) *Attorney, Agent, or Firm*—Wei Te Chung

(57) ABSTRACT

A jack connector (1) includes an insulative housing (2), a charger part (4) received in the housing, an audio jack part (6) also received in the housing, and a signal part (5) located between the charger part and the signal part. The signal part defines a plurality of signal terminals (50) surrounded by a metallic shell (53). The charger part defines a connecting terminal (42) connecting with a printed circuit board. The connecting terminal is located adjacent to the signal part. The connecting terminal defines a spring part (425) elastically abutting against the shell.

17 Claims, 3 Drawing Sheets

JACK CONNECTOR

BACKGROUND OF THE INVENTION

1. Field of the Invention

The present invention generally relates to the art of jack connectors, and more particularly, to jack connectors applied in portable phones.

2. Background of the Invention

A Conventional jack connector used for a portable phone generally includes an insulative housing, a first interface, such as a charger part, and a second interface, such as an audio jack part. The two interfaces are used to recharge the batteries and to connect with external earphones, respectively.

Another conventional jack connector further includes a signal part for exchanging data between the portable phone and a personal computer. In order to eliminate Electro Magnetic Interference (EMI), a ground member is needed. However, because of the limited space in the portable phone, it is difficult to provide a separate ground member to the signal part.

Therefore, a new jack connector having a plurality of interfaces, with anti-EMI function, is accordingly needed.

SUMMARY OF THE INVENTION

In a preferred embodiment of the present invention, a jack connector includes an insulative housing, a first interface received in the housing, a second interface also received in the housing, and a third interface located between the first interface and the second interface. In the preferred embodiment, the first interface is a charger part, the second interface is an audio jack part, and the third interface is a signal part. The signal part defines a plurality of signal terminals surrounded by a metallic shell. The charger part defines a connecting terminal connecting with a printed circuit board. The connecting terminal is located adjacent to the signal part. The connecting terminal defines a spring part elastically abutting against the shell.

Other features and advantages of the present invention will become more apparent to those skilled in the art upon examination of the following drawings and detailed description of a preferred embodiment, in which:

DETAILED DESCRIPTION OF THE PREFERRED EMBODIMENT

Reference will now be made to describe the preferred embodiment of the present invention in detail.

Figure 1:
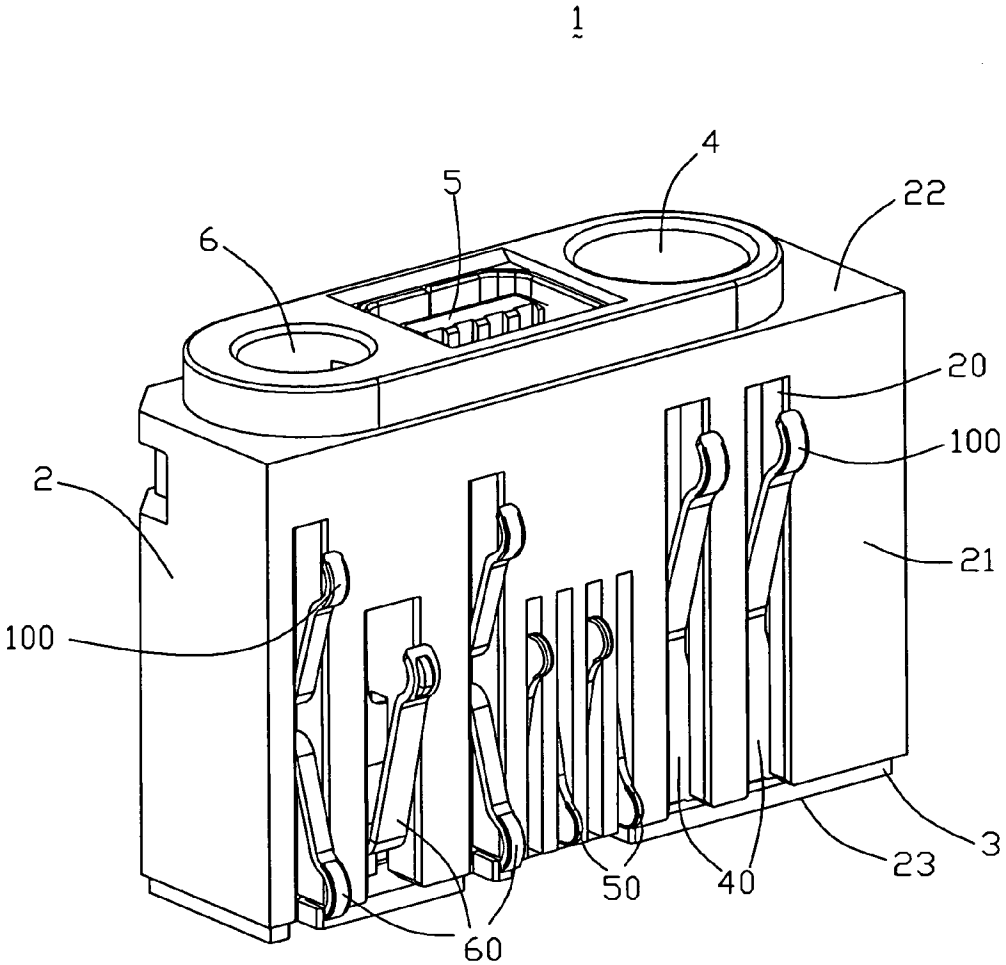
FIG. 1 is an assembled, isometric view of a jack connector in accordance with a preferred embodiment of the present invention.

Referring to FIG. 1, a jack connector 1 used in a portable phone (not shown) includes an insulative housing 2, and a cover 3 removably mounted on the housing 2. The housing 2 accommodates a plurality of interfaces therein. In the preferred embodiment, the interfaces comprise a first interface, such as a charger part 4 for recharging batteries in the portable phone, a second interface, such as a signal part 5 for exchanging data between the portable phone and a personal computer, and a third interface, such as an audio jack part 6 for connecting with an external earphone (not shown).

The housing 2 defines an upper wall 21 and a plurality of passageways 20 extending through the upper wall 21. The charger part 4 defines a plurality of first ground terminals 40. The audio jack part 6 includes a number of second ground terminals 60. And the signal part 5 has a plurality of signal terminals 50. The first and second ground terminals 40, 60 and the signal terminals 50 respectively define a plurality of contacting points 100 extending beyond the housing 2 via the passageways 20 for establishing electrical connection between the jack connector 1 and a printed circuit board received in the portable phone. The first and second ground terminals 40, 60 and the signal terminals 50 are all made of metallic plate by stamping.

The housing 2 defines a plurality of openings 24, 25, 26 respective corresponding to the three interfaces, the openings being defined in a front wall (not labeled) perpendicular to the upper wall 21. The housing 2 further defines a rear wall 23 for cooperating with the cover 3. The cover 3 defined a plurality of protrusions 31 inserting into the housing 2 for fastening the cover 3.

Figure 2:
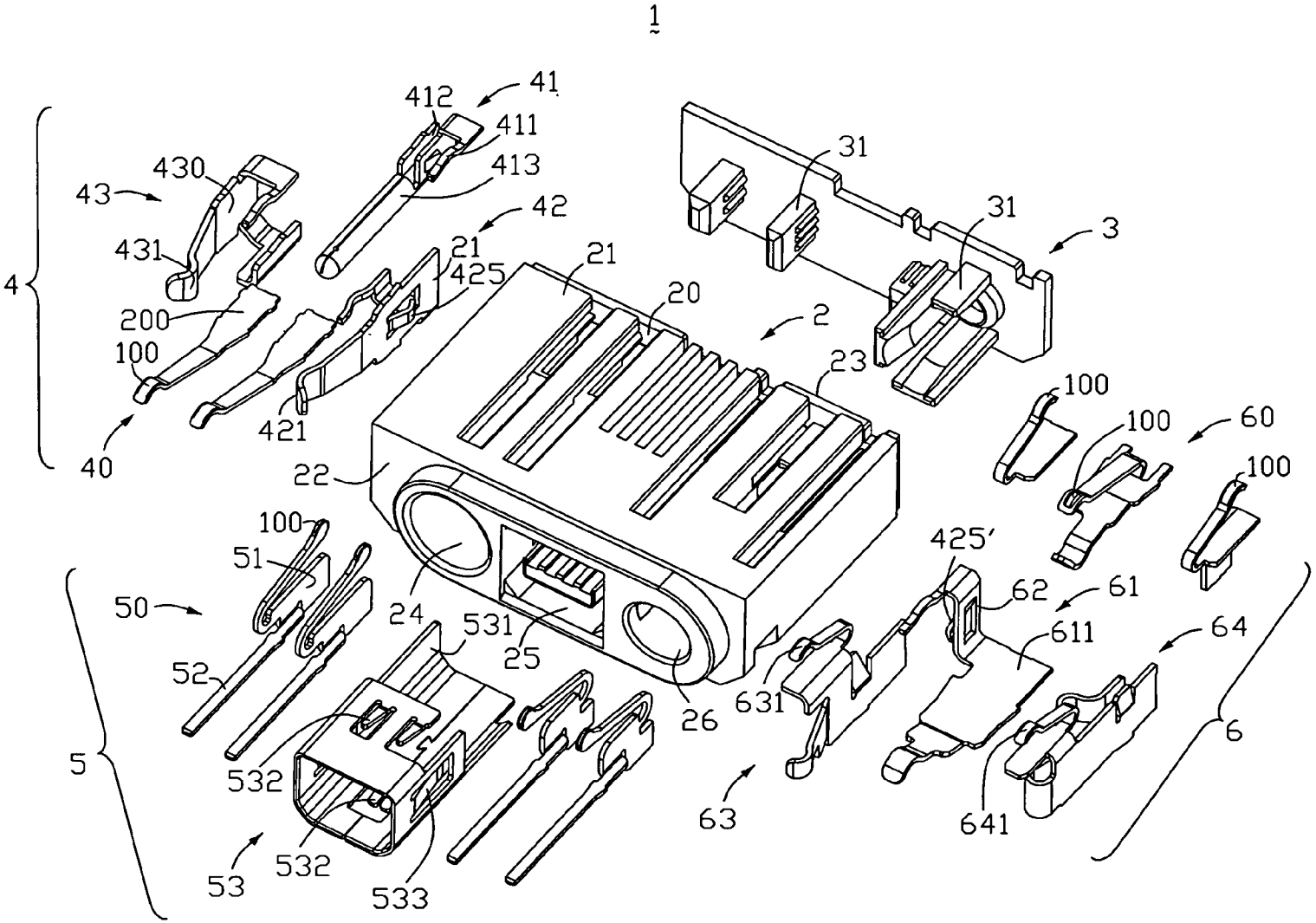
FIG. 2 is an exploded, isometric view of the jack connector of FIG. 1.
Figure 3:
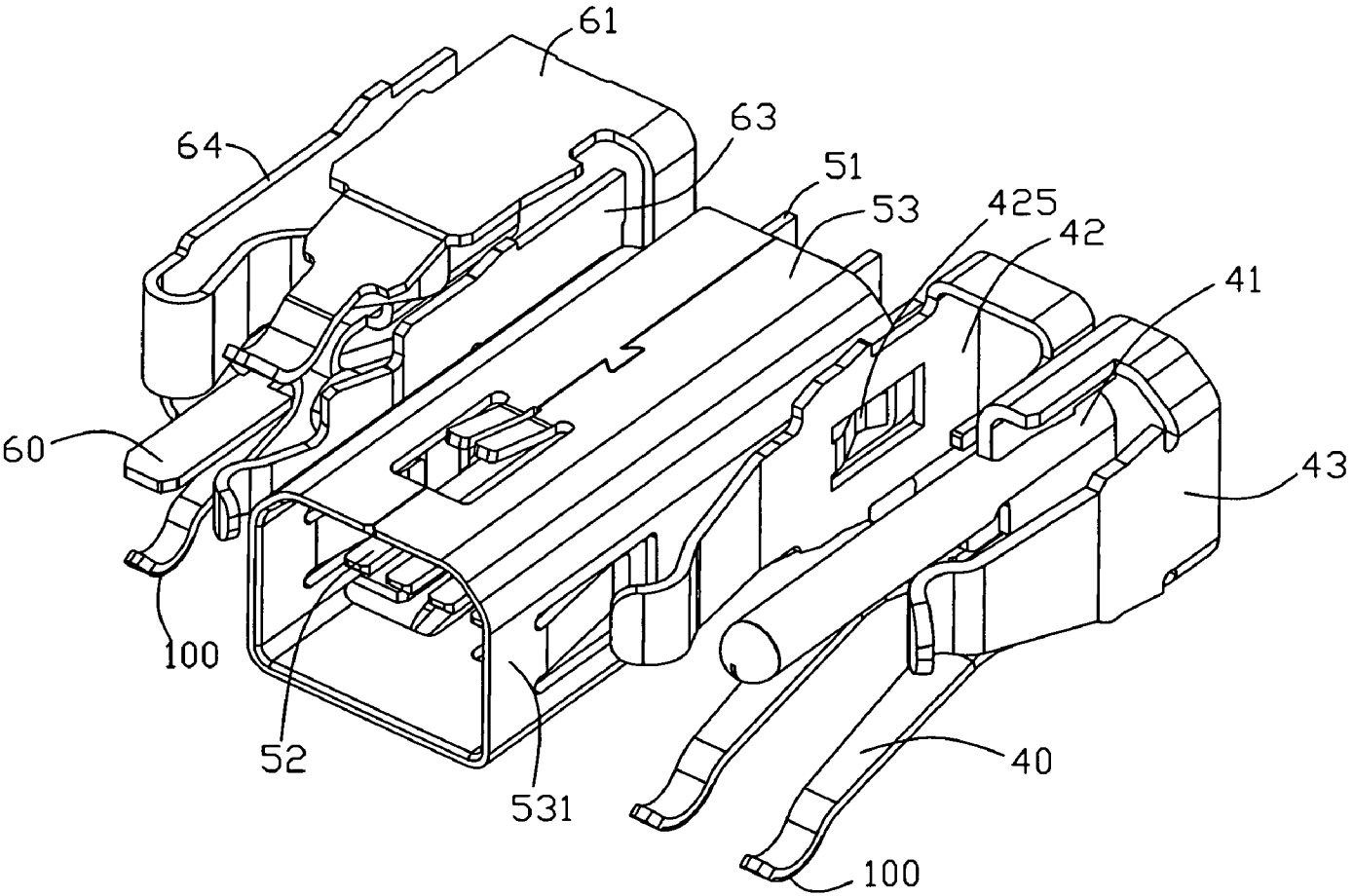
FIG. 3 is an isometric view of the jack connector, only showing three interfaces thereof.

Referring to FIGS. 2-3, the signal part 5 comprises a plurality of signal terminals 50 each defining a first base 51, the contacting point 100 curvedly extending from the first base 51, and a first contacting portion 52 extending from the first base 51 toward to the opening 25. The first contacting portion 52 is used to connect with an external cable connector (not shown). The signal terminals 50 are surrounded by a metallic shell 53 to prevent anti-EMI. The charger part 4 defines a connecting terminal 42 defining a first spring part 425 elastically connecting with the metallic shell 53.

The metallic shell 53 defines a plurality of spring fastening member 532 for cooperating with the housing 2 to positioning the metallic shell 53. Further, the metallic shell 53 defines a plurality of spring tabs 533 extending into the opening 25 for cooperating with an external plug. The metallic shell 53 defines a sidewall 531 connecting with the first spring part 425 for grounding the metallic shell 53.

The charger part 4 includes two first ground terminals 40, a contacting terminal 43 connecting with one of the first ground terminals 40, a connecting terminal 42 defining the first spring part 425, and a central body 41. The central body 41 defines a fastening portion 412, a second contacting portion 411 connecting with the ground terminal 40, and a plugging portion 413 extending toward to the opening 24. The plugging portion 413 locates between the connecting terminal 42 and the contacting terminal 43.

As the signal part 5 is located between the charger part 4 and the audio jack part 6, the first spring part 425 can also be defined on a connecting member 61 of the jack part 6.

The jack part 6 includes three second ground terminals 60 each having the contacting point 100. A first contact 63 and a second contact 64 are positioned adjacent to the connecting member 61 at two opposed sides thereof. The first and second contacts 63, 64 each define a plurality of projections 631, 641 for connecting with the printed circuit board. The connecting member 61 defines a bottom 611, and a connecting part 62 extending upward perpendicular from the bottom 611. The connecting part 62 defines a second spring part 425' elastically connected with the metallic shell 53 for grounding the shell 53.

While the present invention has been described with reference to a specific embodiment, the description of the invention is illustrative and is not to be construed as limiting the invention. Various of modifications to the present invention can be made to the preferred embodiment by those skilled in the art without departing from the true spirit and scope of the invention as defined by the appended claims.

What is claimed is:

1. A jack connector for being mounted on a printed circuit board, comprising:

an insulative housing;

a first interface accommodated in the housing;

a second interface accommodated in the housing, adjacent to the first interface;

a metallic shell surrounding the second interface; wherein the first interface defines a connecting terminal for connecting to the printed circuit board, and the connecting terminal defines a spring member elastically abutting against the metallic shell.

2. The jack connector as claimed in claim 1 further comprising a third interface located in the insulative housing.

3. The jack connector as claimed in claim 2, wherein the first interface is a charger part, the second interface is a signal part, and the third interface is an audio jack part.

4. The jack connector as claimed in claim 3, wherein the signal part is located between the charger part and the audio jack part.

5. The jack connector as claimed in claim 1 further comprising a cover removably mounted on the housing.

6. The jack connector as claimed in claim 5, wherein the cover defines a plurality of protrusions extending into the housing for positioning the cover.

7. A jack connector comprising:

an insulative housing defining therein first and second mating ports neighboring with each other;

a plurality of first contacts disposed in the first mating port;

a plurality of second contacts disposed in the second mating port;

a metallic shell received in the housing and enclosing said first mating port; and one of said second contacts mechanically and electrically connected to the metallic shell; wherein said one of the said second contacts is a grounding contact.

8. The jack connector as claimed in claim 7, wherein said one of the second contacts defines a spring tang extending towards and contacting the shell.

9. The jack connector as claimed in claim 7, wherein either said shell or said one of the second contacts defines a spring tang extending toward the other.

10. The jack connector as claimed in claim 9, wherein said spring tang extends in a transverse direction toward the other while contacting sections of said first contacts and said second contacts essentially extending along a front-to-back direction perpendicular to said transverse direction.

11. The jack connector as claimed in claim 10, wherein each of said first contacts further includes another contacting section extending and exposed out of the housing in a vertical direction perpendicular to both said front-to-back direction and said transverse direction.

12. A jack connector assembly comprising:

an insulative housing;

a metallic shell surrounded by the housing and defining and enclosing therein a mating port, which is open to an exterior, with a plurality of signal contacts therewith, each of said signal contacts defining a mounting section extending beyond a wall of the housing for mounting to a printed circuit board; and a grounding terminal located adjacent to and outside of shell while within the housing and having thereof a connection section engaging the shell for grounding said shell.

13. The jack connector assembly as claimed in claim 12, wherein the grounding terminal is essentially fully hidden behind the wall beyond which said signal contacts extend for mounting to said printed circuit board.

14. The jack connector assembly as claimed in claim 12, wherein said shell is essentially fully embedded and hidden in the housing without direct exposure.

15. The jack connector assembly as claimed in claim 12, wherein said grounding terminal is essentially located in another mating port open to said exterior.

16. The jack connector assembly as claimed in claim 15, wherein said mating port and said another mating port open to said exterior along a same direction.

17. The jack connector assembly as claimed in claim 15, wherein said another mating port is either a jack part or a charger part.

* * * * *